US007490446B1

(12) United States Patent
Chuang

(10) Patent No.: US 7,490,446 B1
(45) Date of Patent: Feb. 17, 2009

(54) LIGHT STEEL CEILING RACK

(76) Inventor: Sen-Jung Chuang, No. 90-10, Hsia Kwei Jou San, Tan Shui Chen, Taipei Hsien (TW)

( * ) Notice: Subject to any disclaimer, the term of this patent is extended or adjusted under 35 U.S.C. 154(b) by 1301 days.

(21) Appl. No.: 10/748,266

(22) Filed: Dec. 31, 2003

(51) Int. Cl.
*E04B 9/00* (2006.01)

(52) U.S. Cl. ..... 52/664; 52/506.06; 52/733.1

(58) Field of Classification Search ..... 52/729.1, 52/733.1, 733.3, 506.06, 506.07, 506.08, 52/506.09, 506.1, 664–670
See application file for complete search history.

(56) References Cited

U.S. PATENT DOCUMENTS 3,142,367 A * 7/1964 Brown et al. ..... 52/506.07
3,159,252 A * 12/1964 Cotts ..... 52/733.1
3,175,655 A * 3/1965 Brown et al. ..... 52/232
4,016,701 A * 4/1977 Beynon ..... 52/733.1
4,128,978 A * 12/1978 Beynon ..... 52/232
5,901,524 A * 5/1999 Wright ..... 52/668
6,244,012 B1 * 6/2001 McGlinchy et al. ..... 52/665
6,851,238 B2 * 2/2005 Rebman ..... 52/506.07

* cited by examiner

*Primary Examiner*—Jeanette Chapman
(74) *Attorney, Agent, or Firm*—Troxell Law Office PLLC

(57) ABSTRACT

A light steel ceiling rack formed of first frame bars and second frame bars, each second frame bar having respective second horizontal top flanges terminating in beveled end edges for engaging into respective notches in the first frame bars and respective first horizontal top flanges provided with end projections for stopping below respective first horizontal top flanges of the first frame bars upon insertion of end plug strips of the second frame bars into respective mounting holes of the first frame bars to enhance the connection and to prevent formation of a gap in the connection area between each first frame bar and each second frame bar.

3 Claims, 7 Drawing Sheets

LIGHT STEEL CEILING RACK

BACKGROUND AND SUMMARY OF THE INVENTION

The present invention relates to a light steel ceiling rack and, more particularly to an improved structure of light steel ceiling rack, which has the connection between the first frame bar and the second frame bar cause a sense of beauty.

FIG. 1 illustrates the arrangement of a light steel ceiling rack according to the prior art. This design has drawbacks. After connection of the end plug strip 41 to the mounting hole 31 of, the first frame bar 3, a gap may exist between the end edge 421 of the flange 42 of the second frame bar 4 and the side edge 321 of the flange 32 of the first frame bar 3 due to inaccurate positioning or tolerance of size, thereby obstructing the sense of beauty and admitting light. Another drawback is the unstable connection between the end plug strip 41 and the mounting hole 31. Further, the base (body) 30 of the first frame bar 3 is formed of two plate members arranged in a stack, and the base (body) of the second frame bar 4 is also formed of two plate members arranged in stack. Both the first frame bar 3 and the second frame bar 4 have a low toughness, thereby lowering the structural strength.

Therefore, it is desirable to provide a light steel ceiling rack that eliminates the aforesaid drawbacks.

The present invention has been accomplished under the circumstances in view. It is the main object of the present invention to provide a light steel ceiling rack, which has a high structural strength. It is another object of the present invention to provide a light steel ceiling rack, which eliminates the formation of a gap in between the first frame bar and the second frame bar after their connection, thereby causing a sense of beauty.

According to one aspect of the present invention, the light steel ceiling rack is formed of first frame bars and second frame bars. Each second frame bar has respective second horizontal top flanges terminating in beveled end edges for engaging into respective notches in the first frame bars, and respective first horizontal top flanges provided with end projections for stopping below respective first horizontal top flanges of the first frame bars upon insertion of end plug strips of the second frame bars into respective mounting holes of the first frame bars to enhance the connection and to prevent formation of a gap in the connection area between each first frame bar and each second frame bar.

According to another aspect of the present invention, the two elongated flat base plates of each of the first and second frame bars include a first elongated flat base plate and a second elongated flat base plate. The first elongated flat base plate comprises a plurality of raised portions. The second elongated flat base plate comprises a plurality of recessed portions respectively forced into engagement with the raised portions of the first elongated flat base plate of the respective second frame bar.

DETAILED DESCRIPTION OF THE INVENTION

Figure 1:
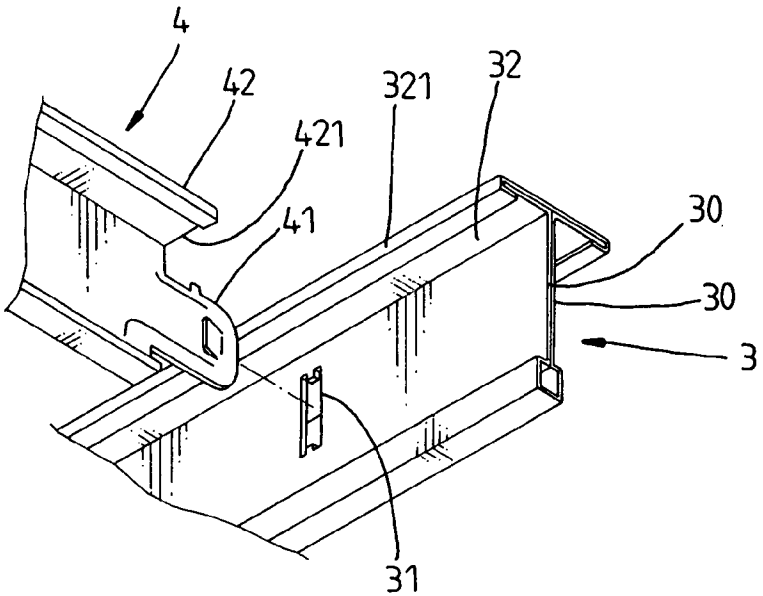
Fig. 1 PRIOR ART
FIG. 1 is an exploded view of the prior art design.
Figure 2:
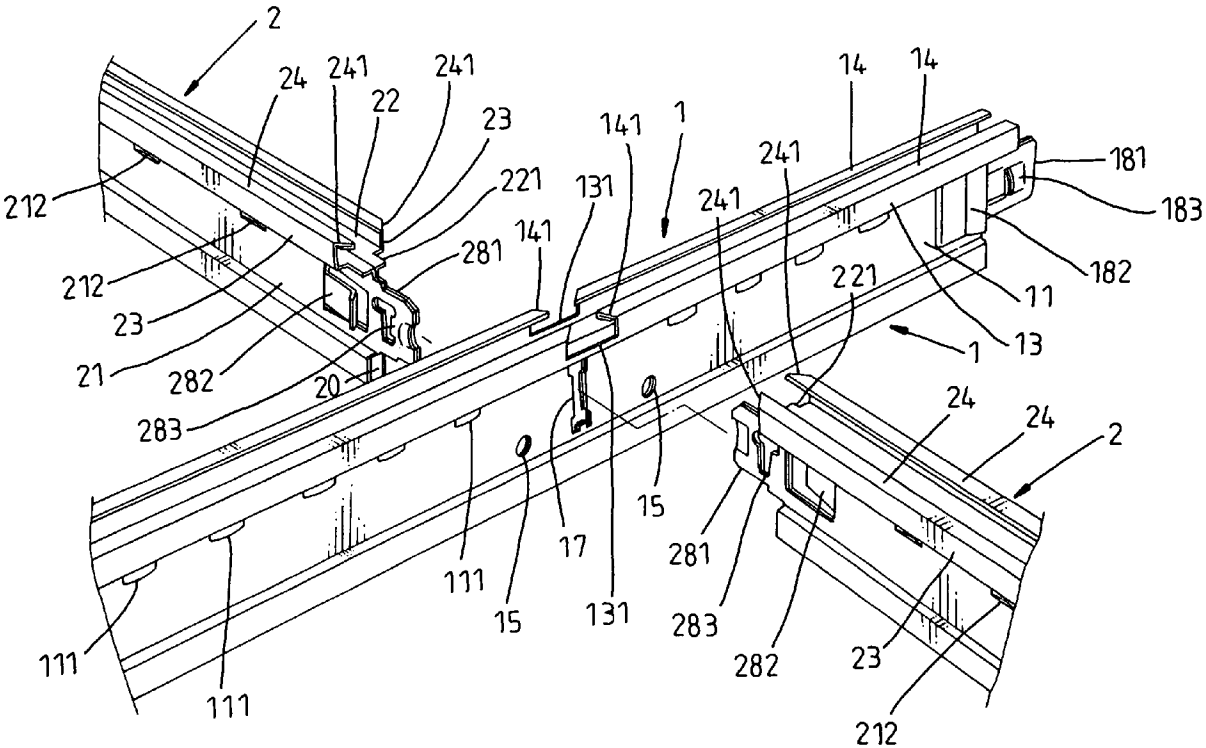
FIG. 2 is an exploded view of a part of the preferred embodiment of the present invention.
Figure 3:
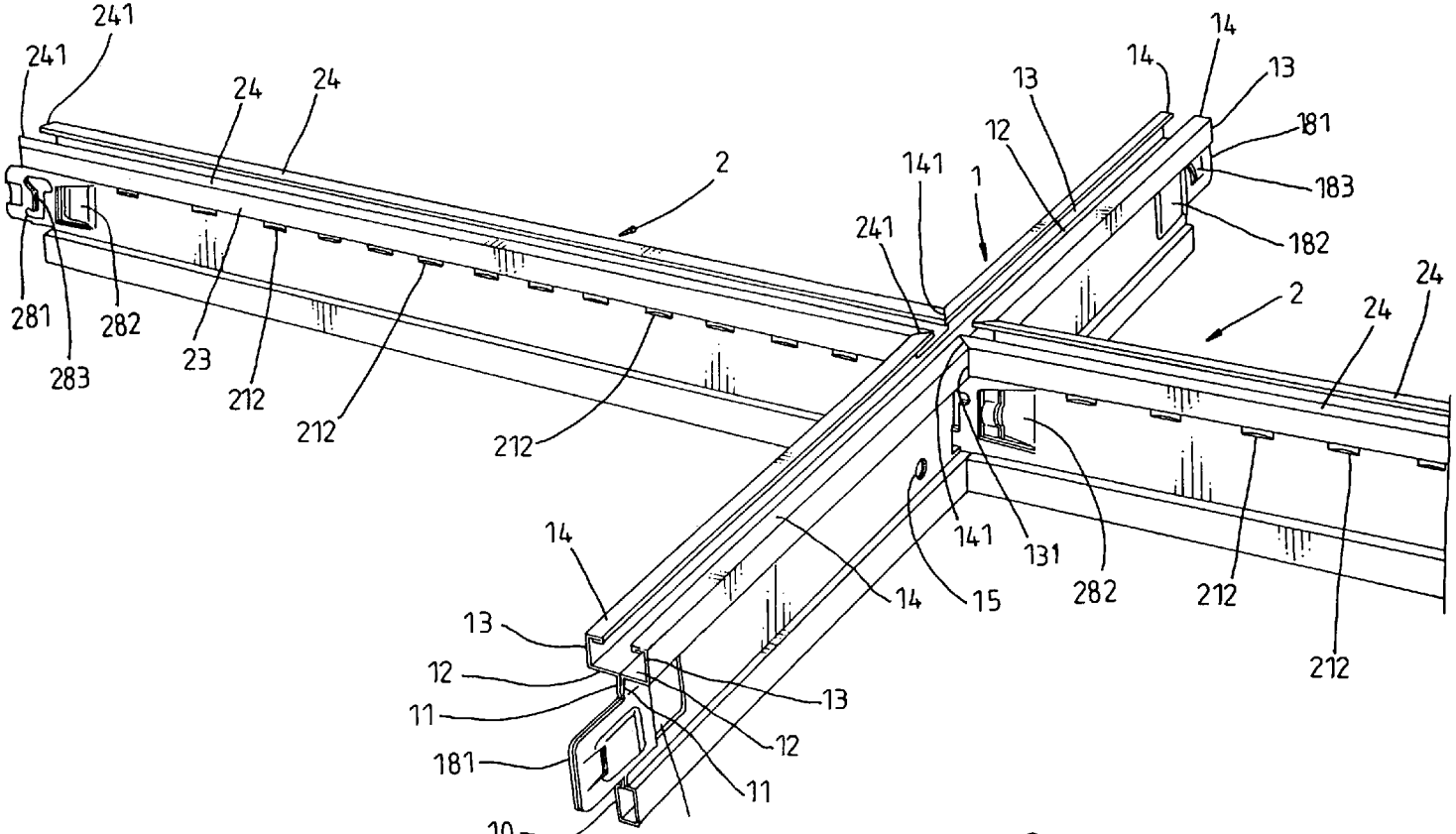
FIG. 3 is an assembly view of FIG. 2.
Figure 4:
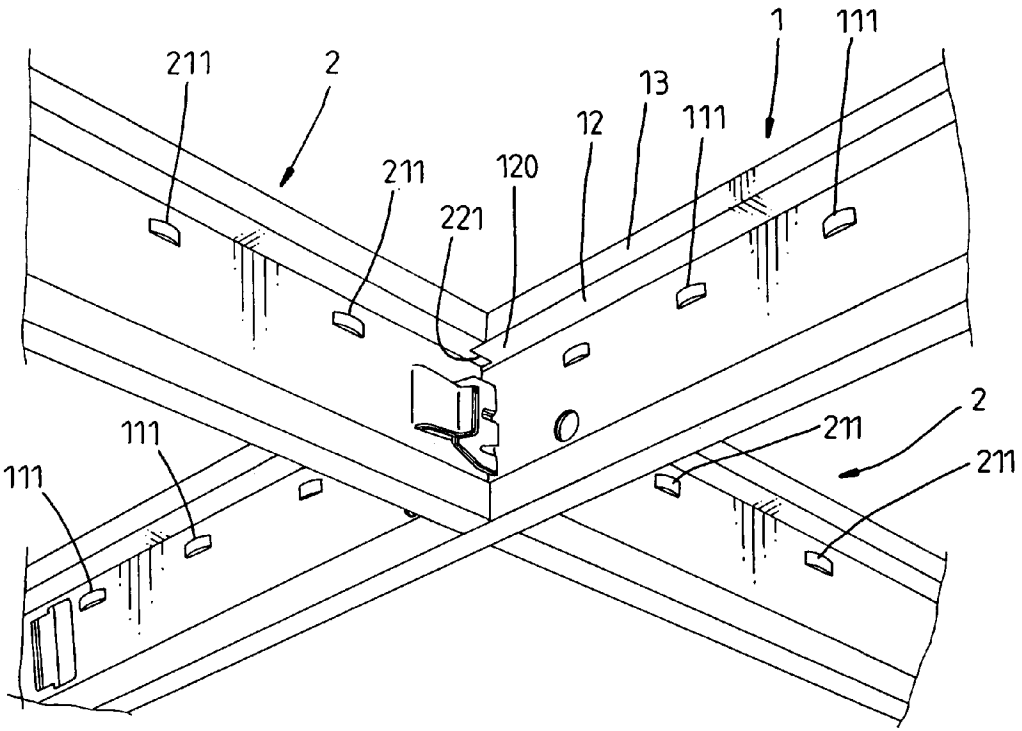
FIG. 4 is another assembly view of FIG. 2 viewed from another angle.
Figure 5:
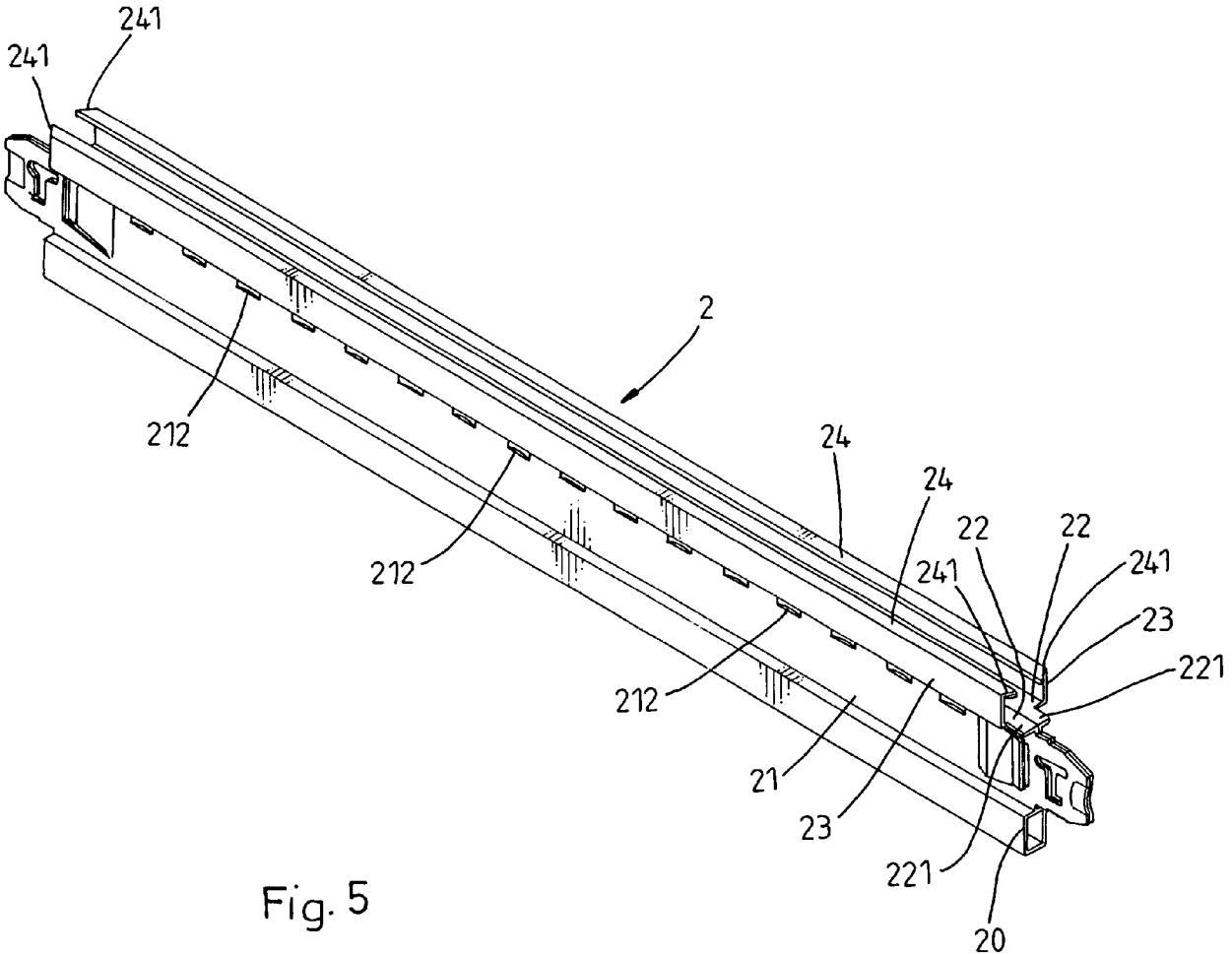
FIG. 5 is an elevational view of one second frame bar for the light steel ceiling rack according to the present invention.
Figure 6:
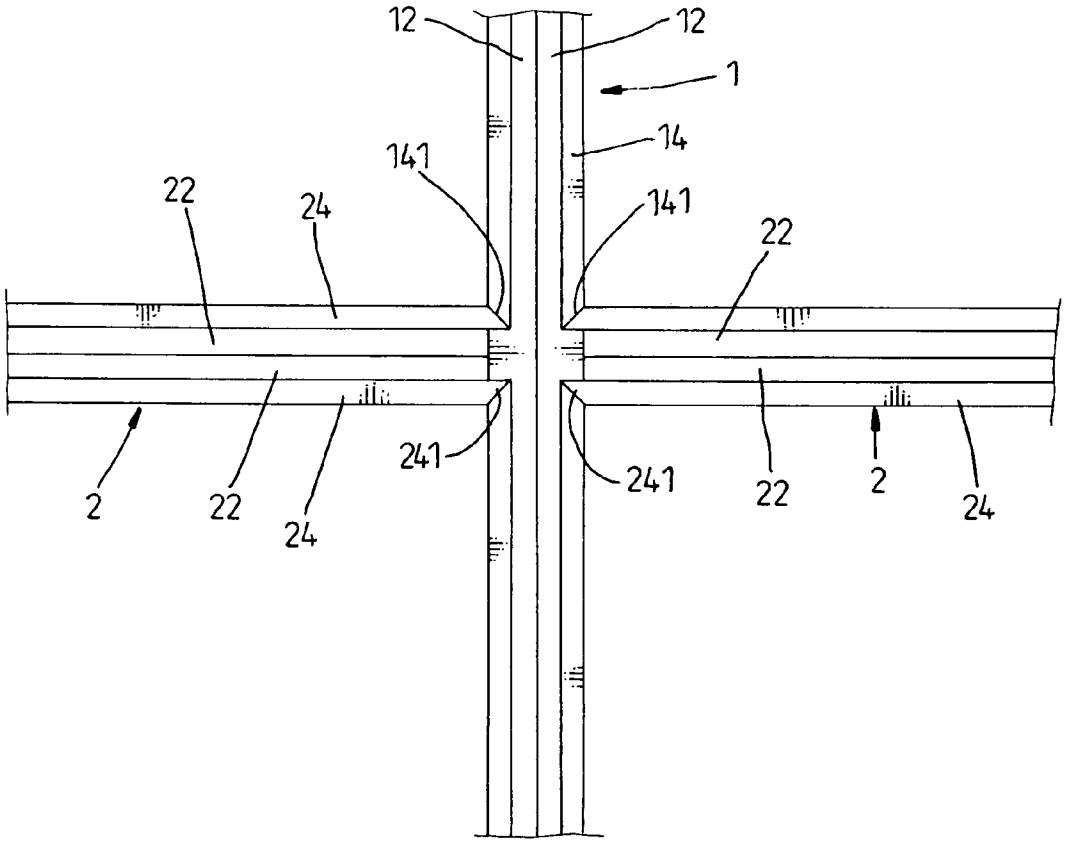
FIG. 6 is a top plain view of the assembly shown in FIG. 3.
Figure 7:
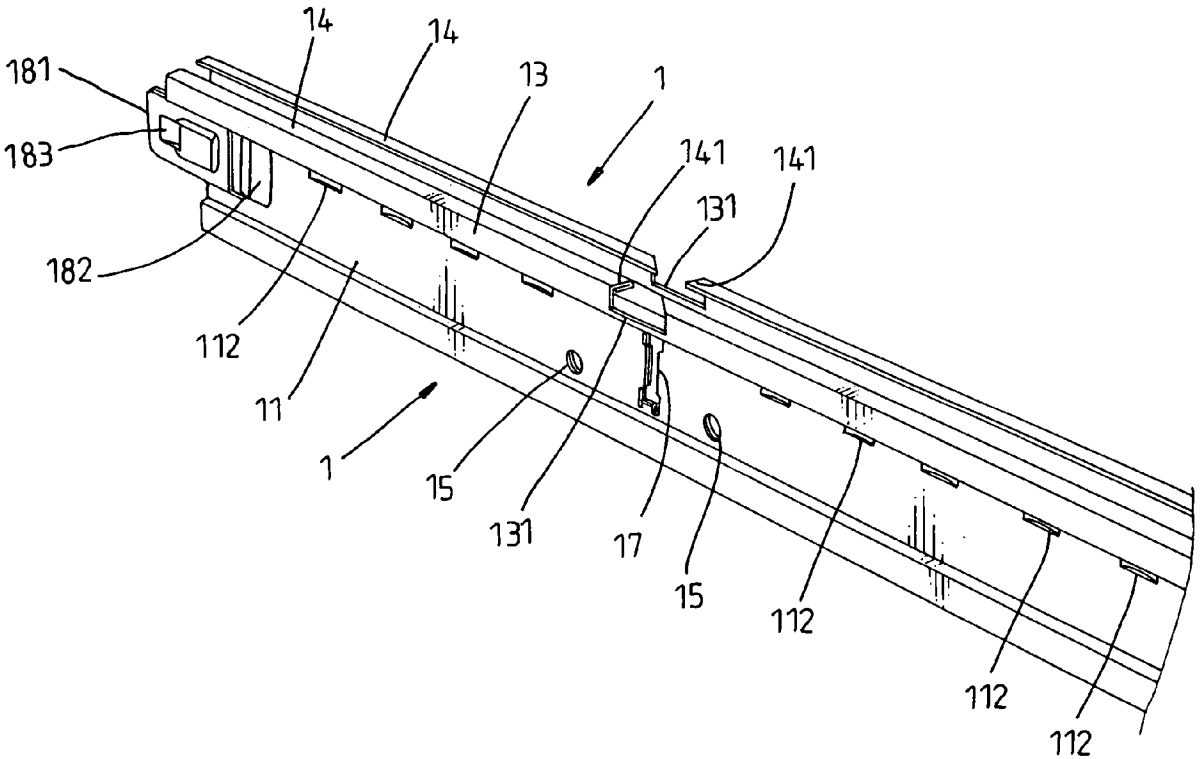
FIG. 7 is an elevational view of one first frame bar for the light steel ceiling rack according to the present invention.

Referring to FIGS. 2~7, a light steel ceiling rack in accordance with the present invention is shown comprised of a plurality of first frame bars 1 and a plurality of second frame bars 2 respectively perpendicularly connected to the first frame bars 1.

The first frame bars 1 are T-bars, each comprising two elongated flat base plates 11 attached together, a bottom track 10 longitudinally formed integral with the bottom sides of the elongated flat base plates 11, two first horizontal top flanges 12 respectively outwardly extended from the top sides of the elongated flat base plates 11 in reverses directions, two vertical top flanges 13 respectively upwardly extended from the outer sides of the first horizontal top flanges 12, two second horizontal top flanges 14 respectively inwardly extended from the top sides of the vertical top flanges 13 and spaced from each other at a distance, a plurality of hanging holes 15 and a plurality of mounting holes 17 cut through the elongated flat base plates 11, an end stop flange 182 transversely disposed at each of the two distal ends, an end plug strip 181 disposed at each of the two ends, and a springy retaining tong 183 provided at each end plug strip 181.

The second frame bars 2 are T-bars, each comprising two elongated flat base plates 21 attached together, a bottom track 20 longitudinally formed integral with the bottom sides of the elongated flat base plates 21, two first horizontal top flanges 22 respectively outwardly extended from the top sides of the elongated flat base plates 21 in reverses directions, two vertical top flanges 23 respectively upwardly extended from the outer sides of the first horizontal top flanges 22, two second horizontal top flanges 24 respectively inwardly extended from the top sides of the vertical top flanges 23 and spaced from each other at a distance, an end stop flange 282 transversely disposed at each of the two distal ends, an end plug strip 281 disposed at each of the two ends, and a springy retaining tong 283 provided at each end plug strip 281. The end plug strips 281 of the second frame bars 2 are to be plugged into the mounting holes 17 of the first frame bars 1. After insertion of one end plug strip 281 of one second frame bar 2 into one mounting hole 17 of one first frame bar 1, the respective springy retaining tong 283 of the respective second frame bar 2 prohibits backward movement of the respective end plug strip 281 from the respective mounting hole 17.

The main features of the present invention are outlined hereinafter. The vertical top flanges 13 of each first frame bar 1 each have a U-notch 131 corresponding to each mounting hole 17 of each first frame bar 1. The second horizontal top flanges 14 of each first frame bar 1 each have a trapezoidal notch 141 corresponding to each mounting hole 17 of each first frame bar 1 and integral with the corresponding U-notch 131 of the corresponding vertical top flange 13. The second horizontal top flanges 24 of each second frame bar 2 each have each end terminating in a beveled end edge 241. The first horizontal top flanges 22 of each second frame bar 2 each have an end projection 221 at each of the two ends corresponding to the beveled end edge 241 at each end of each of the second horizontal top flanges 24.

When inserted one end plug strip 281 of one second frame bar 2 into one mounting hole 17 of one first frame bar 1, the corresponding beveled end edges 241 of the corresponding second horizontal top flanges 24 of the second frame bar 2 are respectively fastened to the trapezoidal notch 141 of one second horizontal top flange 14 of the first frame bar 1, and the end projection 221 of the first horizontal top flanges 22 of the second frame bar 2 are respectively stopped at the bottom side 120 of one first horizontal top flange 12 of the first frame bar 1 (see FIG. 4) to enhance the stability of the connection between the first frame bar 1 and the second frame bar 2 and to eliminate the formation of a gap in the connection area between the first frame bar 1 and the second frame bar 2.

Further, one of the two elongated flat base plates 11 of each first frame bar 1 has a plurality of raised portions 111, and the other of the two elongated flat base plates 11 of each first frame bar 1 has a plurality of recessed portions 112 corresponding to the raised portions 111. The two elongated flat base plates 11 of each first frame bar 1 are fastened together by roller ramming to force the respective raised portions 111 into engagement with the respective recessed portions 112. The engagement between the raised portions 111 and the recessed portions 112 enhances the tightness of the connection and the structural strength of the first frame bar 1.

Further, one of the two elongated flat base plates 21 of each second frame bar 2 has a plurality of raised portions 211, and the other of the two elongated flat base plates 21 of each second frame bar 2 has a plurality of recessed portions 212 corresponding to the raised portions 211. The two elongated flat base plates 21 of each second frame bar 2 are fastened together by roller ramming to force the respective raised portions 211 into engagement with the respective recessed portions 212. The engagement between the raised portions 211 and the recessed portions 212 enhances the tightness of the connection and the structural strength of the second frame bar 2.

As indicated above, the invention achieves the following effects:

1. When inserted one end plug strip 281 of one second frame bar 2 into one mounting hole 17 of one first frame bar 1, the corresponding beveled end edges 241 of the corresponding second horizontal top flanges 24 of the second frame bar 2 are respectively fastened to the trapezoidal notch 141 of one second horizontal top flange 14 of the first frame bar 1, and the end projection 221 of the first horizontal top flanges 22 of the second frame bar 2 are respectively stopped at the bottom side 120 of one first horizontal top flange 12 of the first frame bar 1 to enhance the stability of the connection between the first frame bar 1 and the second frame bar 2 and to eliminate the formation in the connection area between the first frame bar 1 and the second frame bar 2.

2. When the two elongated flat base plates 11 or 21 of each first or second frame bar 2 are fastened together by roller ramming, the respective raised portions 111 or 211 are engaged into the respective recessed portions 112 or 212. The engagement between the raised portions 111 or 211 and the recessed portions 112 or 212 enhances the tightness of the connection and the structural strength of the frame bar 1 or 2.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. A light steel ceiling rack comprising:

a plurality of first frame bars, said first frame bars being T-bars, each comprising two elongated flat base plates attached together, a bottom track longitudinally formed integral with bottom sides of the elongated flat base plates of the respective first frame bar, two first horizontal top flanges respectively outwardly extended from top sides of the elongated flat base plates of the respective first frame bar in reverses directions, two vertical top flanges respectively upwardly extended from the outer sides of the first horizontal top flanges of the respective first frame bar, two second horizontal top flanges respectively inwardly extended from top sides of the vertical top flanges of the respective first frame bar and spaced from each other at a distance, a plurality of hanging holes and a plurality of mounting holes cut through the elongated flat base plates of the respective first frame bar, an end stop flange transversely disposed at each of two distal ends thereof, an end plug strip disposed at each of the two distal ends, and a springy retaining tong provided at each end plug strip of the respective first frame bar; and.

a plurality of second frame bars, said second frame bars being T-bars each comprising two elongated flat base plates attached together, a bottom track longitudinally formed integral with bottom sides of the elongated flat base plates of the respective second frame bar, two first horizontal top flanges respectively outwardly extended from top sides of the elongated flat base plates of the respective second frame bar in reverses directions, two vertical top flanges respectively upwardly extended from respective outer sides of the first horizontal top flanges of the respective second frame bar, two second horizontal top flanges respectively inwardly extended from respective top sides of the vertical top flanges of the respective second frame bar and spaced from each other at a distance, an end stop flange transversely disposed at each of two distal ends thereof, an end plug strip disposed at each of the two distal ends for insertion into the mounting holes of said first frame bars, and a springy retaining tong provided at each end plug strip of the respective second frame bar and adapted to prohibit backward movement of the respective end plug strip from the respective mounting hole into which the respective end plug strip is plugged;

wherein the vertical top flanges of each said first frame bar each have a plurality of U-notches respectively disposed corresponding to the mounting holes of said first frame bars; the second horizontal top flanges of each said first frame bar each have a plurality of trapezoidal notches respectively disposed corresponding to the mounting holes of each said first frame bar and respectively linked to said U-notches; the second horizontal top flanges of each said second frame bar each have each end terminating in a beveled end edge; the first horizontal top flanges of each said second frame bar each have an end projection at each of two distal ends thereof corresponding to the beveled end edge at each end of each of the second horizontal top flanges of each said second frame bar; when inserted one end plug strip of one said second frame bar into one mounting hole of one said first frame bar, the corresponding beveled end edges of the corresponding second horizontal top flanges of the second frame bar are respectively fastened to the trapezoidal notch of one second horizontal top flange of the first frame bar, and the end projection of the first horizontal top flanges of the second frame bar are respectively stopped at a bottom side of one first horizontal top flange of the first frame bar to enhance the stability of the connection between the first frame bar and the second frame bar and to eliminate the formation of a gap in the connection area between the first frame bar and the second frame bar.

2. The light steel ceiling rack as claimed in claim 1, wherein the two elongated flat base plates of each said first frame bar include a first elongated flat base plate and a second elongated flat base plate, the first elongated flat base plate of each said first frame bar comprising a plurality of raised portions, the second elongated flat base plate of each said first frame bar comprising a plurality of recessed portions respectively forced into engagement with the raised portions of the first elongated flat base plate of the corresponding first frame bar.

3. The light steel ceiling rack as claimed in claim 1, wherein the two elongated flat base plates of each said second frame bar include a first elongated flat base plate and a second elongated flat base plate, the first elongated flat base plate of each said second frame bar comprising a plurality of raised portions, the second elongated flat base plate of each said second frame bar comprising a plurality of recessed portions respectively forced into engagement with the raised portions of the first elongated flat base plate of the respective second frame bar.

* * * * *